US005741388A

United States Patent [19]

Gerster et al.

[11] Patent Number: 5,741,388

[45] Date of Patent: Apr. 21, 1998

[54] PROCESS AND APPARATUS FOR SLIP CASTING OF CERAMIC PARTS

[75] Inventors: Thomas Gerster, Laufen; Gerold Spieler, Dornach; Konrad Düblin, Laufen; Stefan Bitter, Wallbach, all of Switzerland

[73] Assignee: Keramik Holding AG Laufen, Laufen, Switzerland

[21] Appl. No.: 496,595

[22] Filed: Jun. 29, 1995

[30] Foreign Application Priority Data

Jun. 29, 1994 [CH] Switzerland ..... 2068/94
Feb. 9, 1995 [CH] Switzerland ..... 375/95

[51] Int. Cl.[6] ..... B28B 1/26

[52] U.S. Cl. ..... 156/245; 156/500; 249/65; 264/86; 264/87; 425/84; 425/85; 425/405.1

[58] Field of Search ..... 156/245, 500; 264/86, 87; 425/84, 85, 86, 405.1; 249/65

[56] References Cited

U.S. PATENT DOCUMENTS 4,798,525 1/1989 Sato et al. ..... 264/86
4,832,890 5/1989 Sato et al. ..... 264/87
4,931,241 6/1990 Freitag ..... 264/86

FOREIGN PATENT DOCUMENTS 3726383 2/1988 Germany .

*Primary Examiner*—Richard Crispino
*Attorney, Agent, or Firm*—Anderson, Kill & Olick, P.C.

[57] ABSTRACT

The apparatus according to the invention for the slip casting of ceramic parts has essentially a bell which is arranged on a holding device and is vertically displaceable and a plurality of mold parts. The latter together with a base part form a mold which stands on a rigid plate. During operation of the apparatus, the mold and the bell covering it form an intermediate space in which are arranged a plurality of inflatable inflatable bladders air pockets which can cooperate in order to clamp the mold and prevent it from moving during the entire casting process. For this purpose, the inflatable bladders are connected to a compressed air source. In addition, a slip supply pipe which communicates with the stated compressed air pipe leads into the mold cavity of the mold, so that pressure equilibration between the mold cavity and the inflatable bladders can be brought about by means of the apparatus according to the invention.

14 Claims, 10 Drawing Sheets

PROCESS AND APPARATUS FOR SLIP CASTING OF CERAMIC PARTS

BACKGROUND OF THE INVENTION

1. Field of the invention

The invention relates to a process and an apparatus for the slip casting of ceramic parts.

The process and the apparatus serve in particular for the production of ceramic wash basins, lavatory bowls and the like.

In known slip casting processes, the slip is poured under a pressure of 0.5 to 2 MPa into a mold cavity of a pressure-resistant, porous mold so that, under the action of this pressure, water contained in the slip is released to the mold parts forming the mold cavity or may be passed through these parts to the outside. This casting process is continued until the slip is dewatered in the region of the inner surfaces of the mold parts, so that the slip is deposited on said surfaces as a layer of a certain thickness. After the formation of this slip layer, referred to below as body, the mold is turned or inclined and compressed air is passed into the mold cavity in order to force the residual slip out of the mold via a slip removal orifice.

2. Description of the prior art

German Patent 37 26 383 discloses a process for the pressure diecasting of ceramic parts of the above-mentioned type. In this process, the mold formed from a plurality of porous mold parts and having a fluid-tight outer surface is arranged inside a pressure-resistant container in order to form an intermediate space which surrounds the mold inside the container. The pressure-resistant container is then sealed, after which the slip is subjected to a first pressure and is introduced into the cavity of the mold. For sealing, the mold is restrained by means of a plurality of clamping devices which can grip the outer surfaces of the mold parts and is held firmly and prevented from moving. Said devices can be formed, for example, by means of inflatable bladders which are arranged in the intermediate space and are capable of restraining the mold by taking up compressed air. Instead of inflatable bladders, however, other clamping devices, such as, for example, hydraulic or pneumatic cylinder units, may also be used for restraining the mold.

A fluid under a second pressure which is higher than the first pressure is then passed into the intermediate space surrounding the mold. The second pressure acts via a communicating connection on the slip present in the mold cavity, with the result that water enters the porous mold parts, preferably consisting of plaster, until a molding of certain thickness has formed inside the mold. Here, the mold parts each have a plurality of channels through which the water entering can be removed from the mold. After formation of the body, the mold is turned, compressed air is passed into the mold cavity and the remaining slip is removed from the mold cavity. After a certain time span has expired, the mold cavity is then let down to atmospheric pressure, the mold is opened and the body formed is unloaded.

The process disclosed in the German Patent 37 26 383 has the substantial disadvantage that the container must be sealed fluid-tight, in particular air-tight, for generation of the second pressure acting on the mold. This condition in fact requires a correspondingly complicated formed apparatus, but in particular a container capable of being sealed fluid-tight, which finally results not only in high procurement costs but also in additional maintenance costs.

Since furthermore the mold parts do not have absolutely smooth outer surfaces, it is very often difficult to produce fluid-tight molds with the apparatus disclosed in the German Patent 37 26 383 and also with other known apparatuses. Accordingly, in the known processes the mold parts are restrained as a rule with such a relatively high pressure acting all around on the mold parts that their life is thereby considerably shortened.

With regard to the production of lavatory bowls, various countries set different requirements for the water consumption and for the laying of the drain trap which carries away the faeces. Thus, for example, lavatory bowls which have a closed water ring with orifices leading into the interior of the bowl are required in countries outside central Europe. It is known that such a lavatory bowl is produced using two molds which can be operated independently of one another and by means of which—separately from one another—two matching moldings are cast and are stuck to one another, i.e. fixed, manually by means of slip at their joint line. The moldings formed here are in particular a first body forming the bowl and a second body forming the water ring.

Processes in which the products to be produced are composed of at least two bodies (these are also referred to below as ceramic parts) have long been known in the industry for ceramic sanitary products. Thus, for example, lavatory bowls having an S-shaped drain trap arranged in the interior are also cast in separate parts and united, in which cases, for example, at least four ceramic parts have to be bonded to one another at their joint lines.

Assembly or fixing is now carried out in principle manually and is thus performed by at least one person. As a result of this and because the lavatory bowls are as a rule produced by the hollow casting process, there is very often a reduction in quality due to a clearly visible joint line in the end product. Lower quality also results from the fact that, in the known processes, the ceramic parts produced in separate casting apparatuses and subsequently united generally cannot be produced under the same physical and chemical conditions and may therefore differ with respect to their consistency.

Finally, the known processes for slip casting of lavatory bowls and the like have the further disadvantage that the individual partial bodies still have to be assembled or fixed manually, resulting, inter alia, in a longer working time.

SUMMARY OF THE INVENTION

It is the object of the present invention—starting from the German Patent 37 26 383 — to provide a process for the slip casting of ceramic parts which does not have the disadvantages of the above-mentioned processes.

This object is achieved according to the invention by a process for the slip casting of ceramic parts, wherein a) at least one mold formed from a plurality of porous mold parts and having a mold cavity being arranged inside a chamber in such a way that an intermediate space at least partly surrounds the at least one mold, b) during a filling process, the slip is being introduced into the mold cavity with a first pressure which is greater than the ambient air pressure, c) before the introduction of the slip into the mold cavity, a fluid is passed into a plurality of inflatable bladders present in the intermediate space, in order thus to restrain the mold in the chamber, the fluid being subjected for this purpose to a pressure which is at least equal to the above-mentioned first pressure, d) at the beginning of the casting process, the fluid present in the air pockets being subjected to a second pressure which is greater than the first pressure, with the result that water from the slip enters the mold parts until a body of a certain thickness is formed inside the mold cavity, e) this second pressure holds together the at least one mold in a pressure-resistant manner during the entire casting process, and f) after formation of the body, the residual slip being removed from the mold cavity and the molding being removed from the at least one mold.

The invention furthermore relates to an apparatus for carrying out the process as defined above, having a chamber and at least one mold which is formed from a plurality of porous mold parts, has a mold cavity and is to be arranged inside the chamber in such a way that the intermediate space at least partly surrounds the mold, wherein a plurality of inflatable bladders which are arranged in the intermediate space and adjacent to the exposed lateral walls of the at least one mold are present, which air pockets can be supplied with a fluid and can be inflated in such a way that they are capable of restraining the at least one mold during the filling and casting process.

The invention also relates in particular to a process for the slip casting of lavatory bowls and the like, which permits the production of a product from at least two ceramic parts which can be connected to one another, and which is at least in part automatically controllable and gives relatively high product quality.

BRIEF DESCRIPTION OF THE DRAWINGS

The subject of the invention is now illustrated in more detail by embodiments shown in the drawings. In the drawings.

DETAILED DESCRIPTION OF THE PREFERRED EMBODIMENTS

Figure 1:
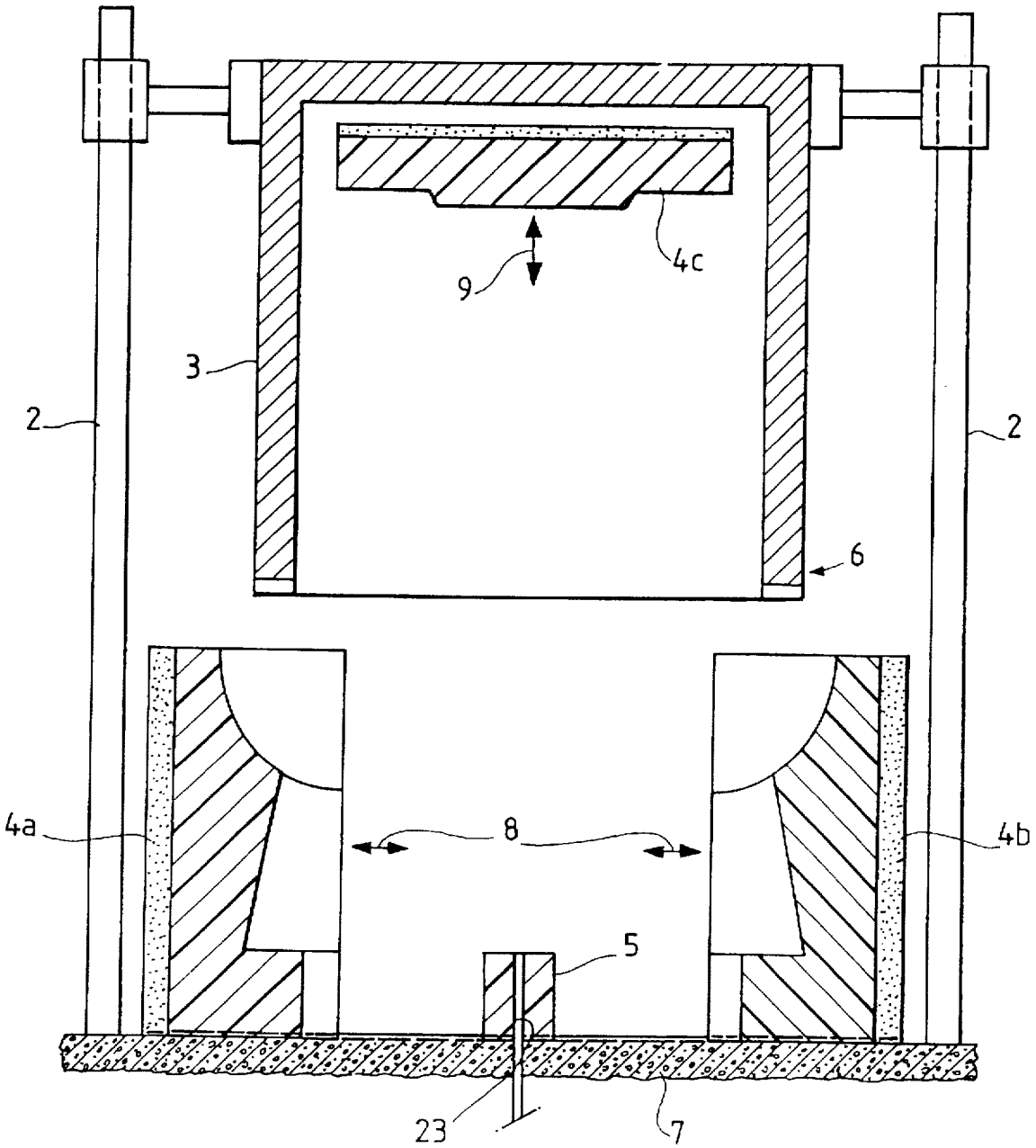
FIG. 1 shows schematically, partly in section and partly as a view, an apparatus for the slip casting of a lavatory bowl, with mold parts detached from one another.
Figure 2:
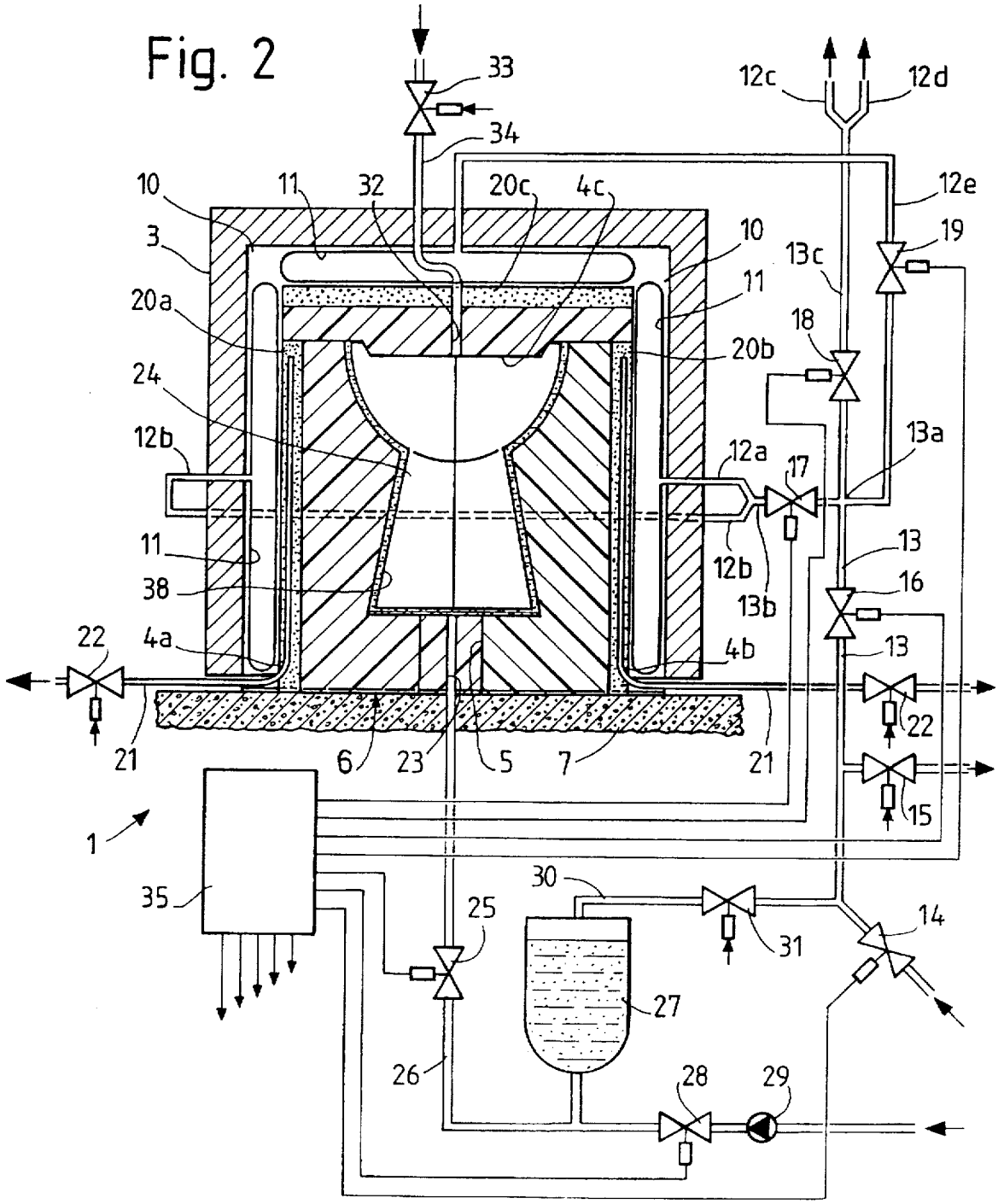
FIG. 2 shows a schematic view of this apparatus in the operating state.

The apparatus shown in FIGS. 1 and 2 and denoted as a whole by 1 and intended for the slip casting of ceramic parts has essentially one bell 3 which is arranged on a holding device 2 and can be displaced vertically and three mold parts 4*a*, 4*b* and 4*c*. The latter together with a base part 5 and a further mold part—not shown in the drawing—form a mold 6 which stands on a rigid plate 7 preferably formed from metal or concrete.

As is evident from the drawings, FIG. 1 shows the mold parts 4*a*, 4*b*, 4*c* and 5 in a state detached from one another, whereas FIG. 2 shows the mold 6 in the state ready for operation. It is clear from these Figures that the mold parts 4*a*and 4*b* can be displaced horizontally relative to one another in the direction 8 indicated by the arrow. The mold part 4*c* forming the cover of the mold 6 can be displaced vertically with respect to the above mold parts in the direction 9 indicated by the arrow. The mold part 4*c* can be fixed to the bell 3, for example by holding means not shown in FIG. 1.

Each of the above-mentioned mold parts 4*a*, 4*b* and 4*c* preferably consists of a porous material, for example of polyacrylate resin or of another comparable material. These mold parts have a plurality of essentially parallel passages through which the slip water entering the mold parts of the apparatus 1 during operation can be passed. Mold parts which can be used for the apparatus according to the invention are preferably produced by the process disclosed in U.S. Pat. No. 4,591,472.

As shown in FIG. 2, in the operating state the mold 6 and the bell 3 covering said mold and together with the plate 7 forming a chamber bound an intermediate space 10 which at least partly surrounds the mold 6. A plurality of inflatable bladders 11, preferably five such inflatable bladders, which incorporate to prevent the mold 6 from moving during the entire casting process, are arranged in this intermediate space 10. For this purpose, the inflatable bladders 11 almost completely cover the lateral surfaces of the mold 6 and are connected via air pipes 12*a* to 12*e* to an air supply pipe 13, which in turn is connected via an inlet valve 14 to a compressed air source which is not shown in FIG. 2. Said source has, for example, at least one compressor and one storage container in order to produce a compressed gas, namely compressed air. The air supply pipe 13 is furthermore connected via an air outlet valve 15 to the outside atmosphere. In order to reduce the amount of compressed air which has to be fed into the inflatable bladders 11 for completely clamping the mold 6, it is advantageous to provide a relatively narrow intermediate space 10.

As is furthermore evident from FIG. 2, the compressed air supply pipe 13 has a controllable shut-off member 16, by means of which the pressure of the air to be passed into the inflatable bladders 11 can be regulated. Further valves 17, 18 and 19 which are also controllable are arranged in the pipe sections 13*b* and 13*c*, which are downstream of the distributor intersection 13*a*, and in the air pipe 12*e*.

Each of the mold parts shown is provided on its outer surface with an outer layer 20*a* or 20*b* or 20*c*. These outer layers serve in particular to take up and remove the pressurized water passed through the above-mentioned passages. For this purpose, each outer layer is operationally connected to a flexible hose 21 which is connected via a valve 22 to the outside atmosphere.

The base part 5 of the mold 6 has an orifice 23 through which the slip can be introduced into the mold cavity 24 of the mold 6 and removed therefrom again. For this purpose, the orifice 23 is connected to a slip reservoir 27 via a pipe 26 having a shut-off member 25. Particularly for slip introduction, the pipe 26 is additionally connected via a valve 28 and a pump 29 to a slip source not shown in the drawing.

As additionally shown in FIG. 2, the slip reservoir 27 communicates with the compressed air pipe 13 via a compressed air pipe 30 in which a further shut-off member 31 is arranged, so that pressure equilibration between the mold cavity 24 and the inflatable bladders 11 can be brought about by means of the apparatus 1 according to the invention.

Finally, the mold part 4c also has an orifice 32 which leads into the mold cavity 24 and is connected to a pipe 34 having a shut-off member 33. As in the case of the pipe 13, said pipe 34 is connected to a compressed air source which is not shown.

The valves and shut-off members 14–19, 22, 25, 28, 31 and 33 shown in FIG. 2 and mentioned above each have a passage and closure means serving for alternatively shutting off or opening the passage, and are connected to an electronic monitoring and control means 35 via at least one pneumatic line serving for supplying and/or removing compressed air, only one such line being shown per valve or shut-off member in FIG. 2. In particular, the valves or shut-off members 16 to 19 and 31 are pneumatically controllable in such a way that the passage cross-sectional areas which can be opened by the closure means can be adjusted at least stepwise.

The electronic monitoring and control means 35 serves for completely or partly automatically controlling the casting process described below. This control means 35 includes a control circuit having electrical and/or electronic components for measurement, control and regulation. The control means 35 may also have control elements which can be operated and by means of which at least some of the functions controllable by the control means 35 can be manually executed.

Figure 3:
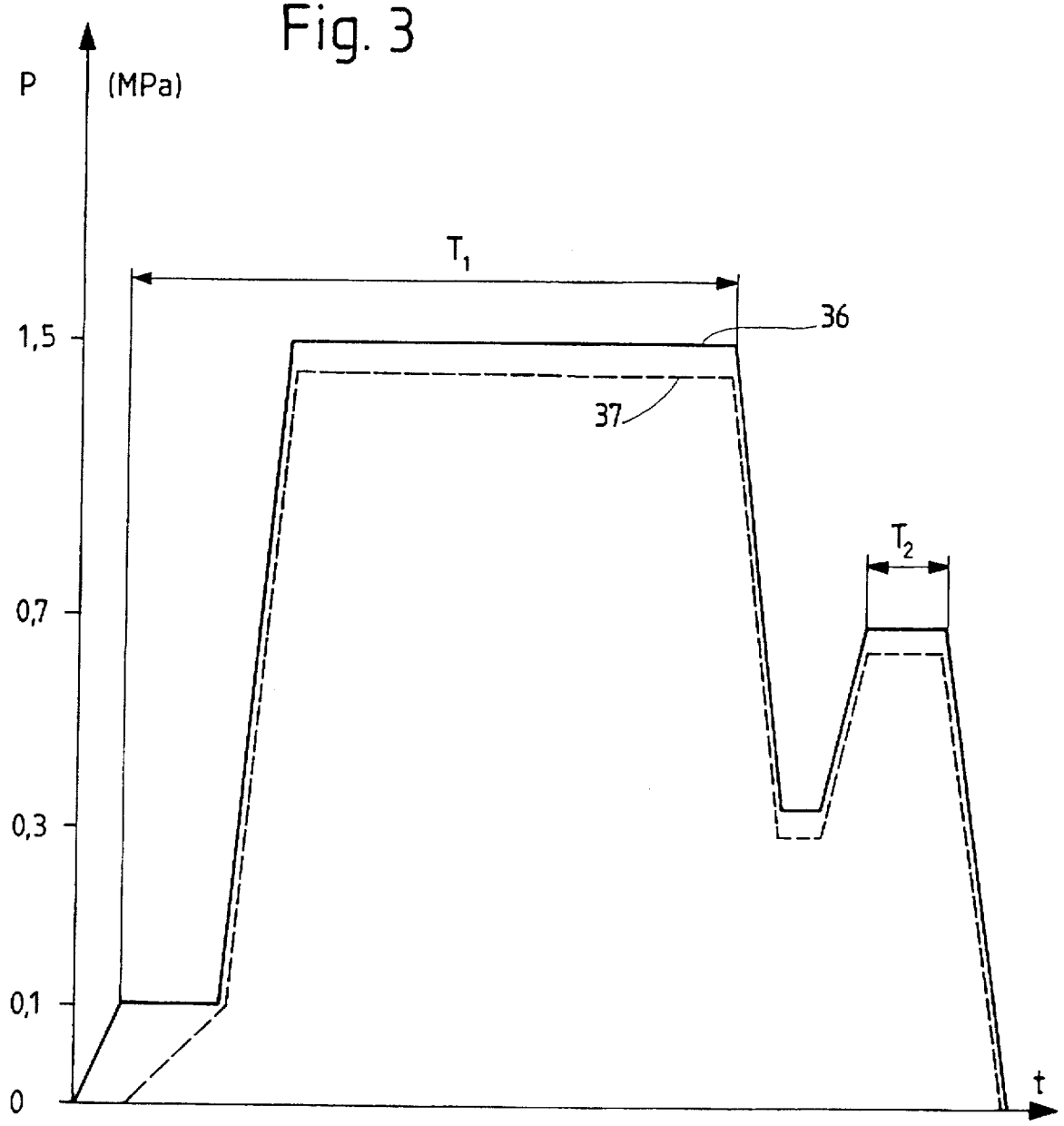
FIG. 3 shows a pressure-time graph for illustrating the casting process.

The casting process according to the invention is explained in more detail below with reference to FIG. 3. The time t is plotted along the abscissa of FIG. 3 and the pressure P along the ordinate. In the graph, the solid curve 36 shows the pressure variation within the air pockets 11 during the entire process, and the dashed curve 37 shows the corresponding pressure variation within the mold cavity 24. Regarding the pressure values mentioned below, it should also be noted at this point that these should be designed so that they are each larger than the ambient air pressure by the stated value.

If it is intended to produce a ceramic wash basin using the apparatus 1 shown in FIGS. 1 and 2, the mold parts 4a, 4b and 4c forming the mold 6 are displaced in the direction indicated by the arrows 8 and 9 so that the operating state shown in Figure 2 is established.

The shut-off member 16 and the valves 14, 17, 18 and 19 are then opened and air at a pressure of about 100–300 kPa is passed into the inflatable bladders 11 in order to inflate them and to restrain the mold 6 formed from the mold parts 4a, 4b and 4c.

At the same time or shortly thereafter, with shut-off member 25 closed, the slip feed valve 28 is opened and slip is passed into the reservoir 27 by means of the pump 29 (or by means of compressed air).

As soon as a pressure of about 100 kPa has stabilized in the inflatable bladders 11, the shut-off member 16 and the slip feed valve 28 are closed, the valves 31 and 25 are opened and compressed air is used to pass at least some of the slip previously introduced into the reservoir through the pipe 26 into the mold cavity 24. Here, the valves 22 of the pressure-relief hoses 21 are opened so that at least some of the air contained in the mold cavity 24 during introduction of the slip can flow out via the porous mold parts 4 and the pressure-relief hoses 21. During filling of the mold cavity 24 with slip, an internal pressure of at most 100 kPa builds up in said mold cavity. This pressure build-up and the monitoring of the slip level in the mold 6 are carried out by the electronic monitoring and control means 35.

A pressure which is, for example, from 1 to 2 MPa, but preferably 1.5 MPa, is then built up in the inflatable bladders 11—via the air supply pipe 13. When shut-off member 31 is opened, it is ensured that the pressure in the inflatable bladders 11 is equal to that which acts on the free surface of the slip in the reservoir 27. Since this reservoir 27 has a fluid connection to the mold cavity 24, the pressure acting on the slip in the mold cavity is also equal to the pressure acting on the slip in the reservoir 27. Accordingly, application of virtually the same pressure both at the relevant inner surface and at the relevant outer surface of each mold part is achieved. As shown in FIG. 3, the pressure prevailing in the mold cavity 24 during the casting process is only approximately equal to the pressure acting in the inflatable bladders 11 but is preferably lower than this. This pressure difference serves in particular to keep the mold in an optimally restrained and secured position during the entire casting process. The pressure difference is established and regulated by the electronic control means 35, in particular the shut-off members 16 and 31 being regulated differently for this purpose.

After the casting pressure which is required for pressure diecasting and is preferably 1.5 MPa has been established, the water contained in the slip passes through the porous mold parts 4 into the outer layers 20, whereupon the body 38 or the molding of the wash basin to be produced is formed.

Next—with preferably constant casting pressure and open valves 22—the pressurized water flowing through each mold part 4 can be removed via the hoses 21.

After a time span $T_1$ which is calculated from the beginning of the filling process and is about 200 to 400 seconds, for example 300 seconds, the body 38 has completely formed. After the formation of the body 38, both the inflatable bladders 11 and the mold cavity 24 are partially vented. This can be effected, for example, by opening the air outlet valve 15. However, during the pressure decrease in the mold cavity 24, compressed air is passed once again—and with shut-off member 33 open—through the pipe 34 into the mold cavity 24 in order to remove slips still present therein via the slip pipe 26. The residual slip removed from the mold in this manner flows, for example via the shut-off member 25, into the reservoir 27, in which it is stored for further use. However, the slip may be removed via an additional pipe which is connected to the pipe 26 and is not shown.

During the above-mentioned pressure decrease, the valves or shut-off members 14, 15, 16, 31 and 33 are controlled by the electronic monitoring and control means 35 in such a way that a pressure of about 0.3 MPa is maintained both in the mold cavity 24 and in the inflatable bladders, the pressure in the inflatable bladders 11 preferably being kept slightly higher than in the mold cavity 24.

As soon as the slip discharge process is complete, compressed air is passed once again via the line 34 into the mold cavity 24, at least until an internal pressure of, for example, 0.5 to 1 MPa, preferably 0.7 MPa, has built up therein. Of course, the other, above-mentioned valves and shut-off members are regulated and controlled by the monitoring and control means 35 in such a way that the pressure prevailing in the inflatable bladders 11 also increases again by the same pressure increment.

During a subsequent time span $T_2$ of about 20 to 60 seconds, the body 38 is further dewatered, namely until it contains only at most 20% by weight, for example 17% by weight, of water.

After this dewatering phase—depending on the shape of the curves 36 and 37, the mold cavity 24 and the inflatable bladders 11 are finally vented together. The mold 6 is then opened and the body 38 is removed, for this purpose compressed air preferably being passed through the hose 21 from the outside in order thus to detach the moist body 38 from the inner wall of the mold 6.

As is evident from FIG. 2, further additional valves, namely the valves 17, 18 and 19 also controllable by the monitoring and control means 35, are arranged in the pipe sections 13*b* and 13*c* which are downstream of the distributor intersection 13*a* and in the air pipe 12*e*. Said valves serve in particular for establishing pressure conditions differing from one another in the inflatable bladders 11, the inflatable bladders 11 arranged at the lateral walls of the mold 6 each being controllable in pairs and separately from one another and also separately from the inflatable bladder 11 adjacent to the mold part 4*c*. With this additional freedom of pressure regulation, it is possible to ensure that the different mold parts 4*a*, 4*b* and 4*c* remain optimally braced together during the entire casting process and together form a fluid-tight mold 6, and do so without it being necessary to load the mold part mechanically to an excessive extent, so that the life of the mold parts is increased as far as possible.

Compared with the apparatus described in the introduction and disclosed in the German patent 37 26 383, the apparatus according to the invention has the advantage that it is based on a simpler design. The bell 3 intended for covering the mold 6 need not in fact have a fluid-tight seal. This is the case in particular because the external pressure required during the casting process and acting on the mold 6 is built up not in the intermediate space 10 but inside the inflatable bladders 11 arranged in the intermediate space 10.

Figure 4:
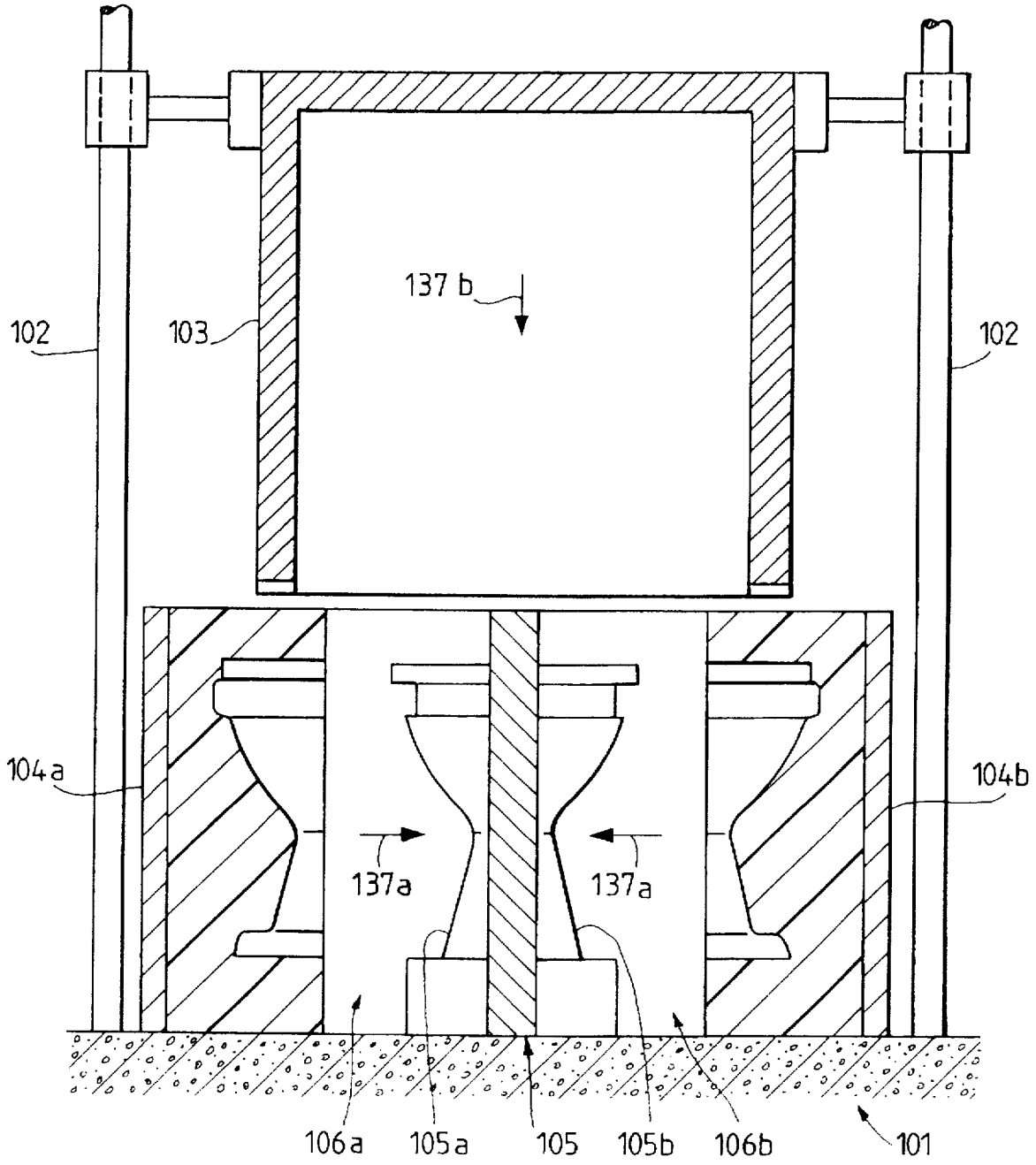
FIG. 4 shows a schematic view of an apparatus for the production of a ceramic lavatory bowl, with two molds arranged side by side.
Figure 5:
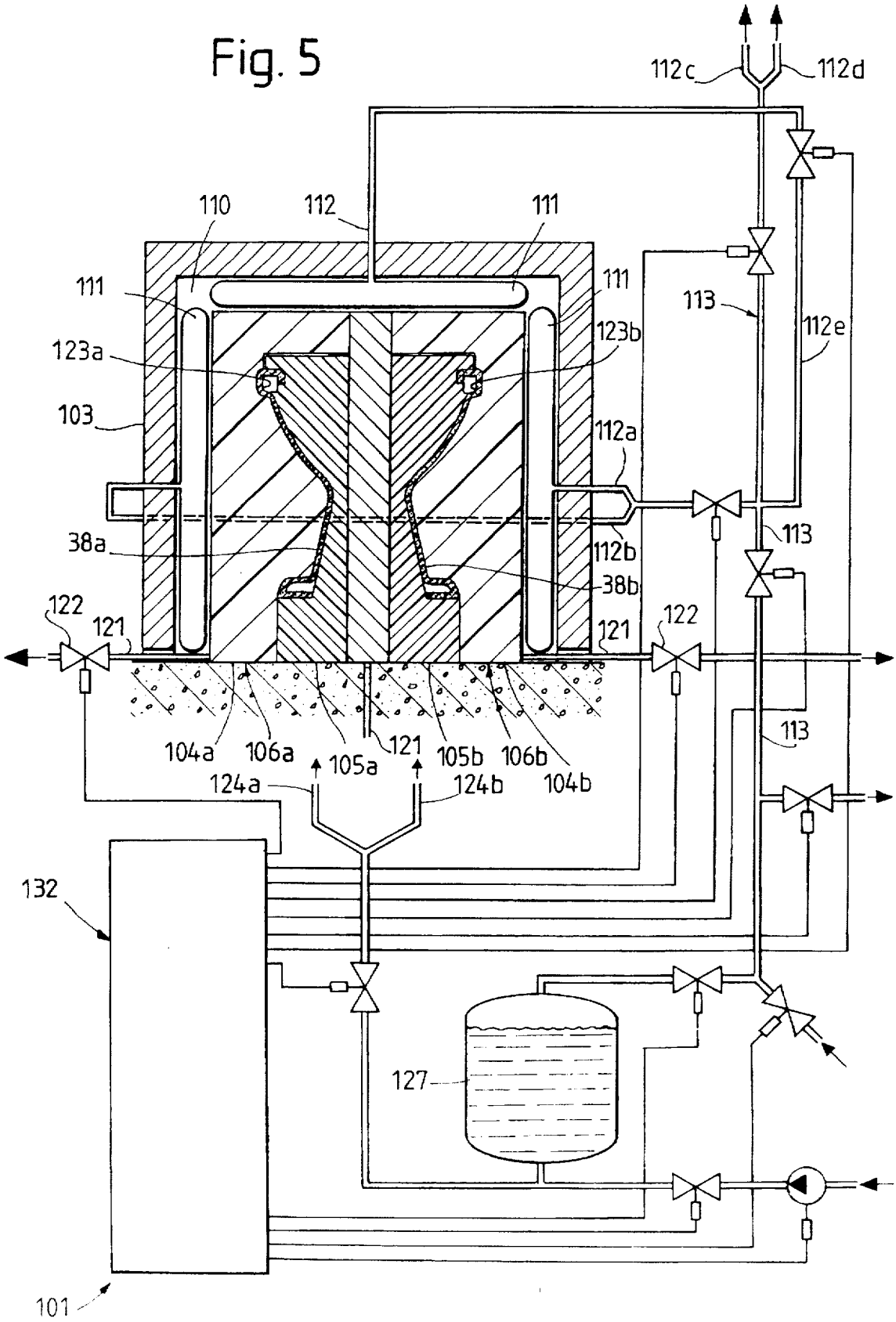
FIG. 5 shows a schematic view of the apparatus shown in FIG. 4, in the operating state.

The apparatus, shown in FIGS. 4 and 5 and denoted as a whole by 101, for slip casting a ceramic lavatory bowl is generally formed in the same way as the apparatus 1 described above and has a vertically displaceable bell 103, arranged on a holding device 102, and a plurality of horizontally displaceable mold parts, two of which are shown in the drawing and are denoted by 104*a* and 104*b*. In this embodiment, these mold parts 104a and 104*b*, together with a two-part, stationary mold part 105, form two molds 106*a* and 106*b*. For this purpose, the mold part 105 has two sections 105*a* and 105*b* which are arranged symmetrically with respect to one another across a plane and are formed as cores and each of which forms a part of a mold 106*a* and 106*b*, respectively. The drawing shows that the lavatory bowl which can be produced using the apparatus 101 is composed of two ceramic parts which are to be joined to one another at vertical edges, each such part being cast in a mold 106*a* or 106*b*.

In the operating state, the molds 106*a* and 106*b* and the bell 103 covering them together bound an intermediate space 110, as shown in FIG. 5. A plurality of inflatable inflatable bladders 111, preferably five thereof, are arranged in this intermediate space 110 and can cooperate in order firmly to clamp the molds 106*a* and 106*b* during the casting process and to prevent them from moving. The inflatable bladders 111 are formed in the same way as the inflatable bladders 11 of the apparatus 1, i.e. virtually completely cover the free lateral surfaces of the molds 106*a* and 106*b* and are connected to an air supply pipe 113 via air pipes 112*a* to 112*e*.

As is furthermore evident from FIG. 5, a mold part 104*a* and a mold part 104*b*, each together with a section 105*a* and 105*b*, respectively, and other mold parts not shown, bound a mold cavity 123*a* and 123*b*, respectively. A pipe 124*a* or 124*b*, through which the slip can be fed to the mold cavity 123*a* or 123*b* and from which said slip can be removed again leads into each mold cavity 123*a* or 123*b*.

The apparatus 101 is moreover formed in exactly the same way as the apparatus 1 described above, i.e. possesses like the latter, inter alia, a plurality of controllable valves, a slip reservoir 127 and an electronic monitoring and control unit 132.

If it is intended to produce a lavatory bowl using the apparatus 101 shown in FIGS. 4 and 5, the mold parts 104*a* and 104*b*, forming the molds 106*a* and 106*b*, and the bell 103 are displaced in the direction indicated by the arrows 137*a* and 137*b* so that the operating state shown in FIG. 5 is established.

Air is then passed into the inflatable bladders 111 and slip into the mold cavities 123*a* and 123*b*, this being done in the manner already described above with reference to the apparatus 1. For this purpose, in particular the valves 122 of the pressure-relief hoses 121 are opened so that the air still present during filling of the slip into the mold cavities 123*a* and 123*b* can flow out through the porous mold parts 104*a*, 104*b* and 105 and the pressure-relief hoses 121.

Figure 6:
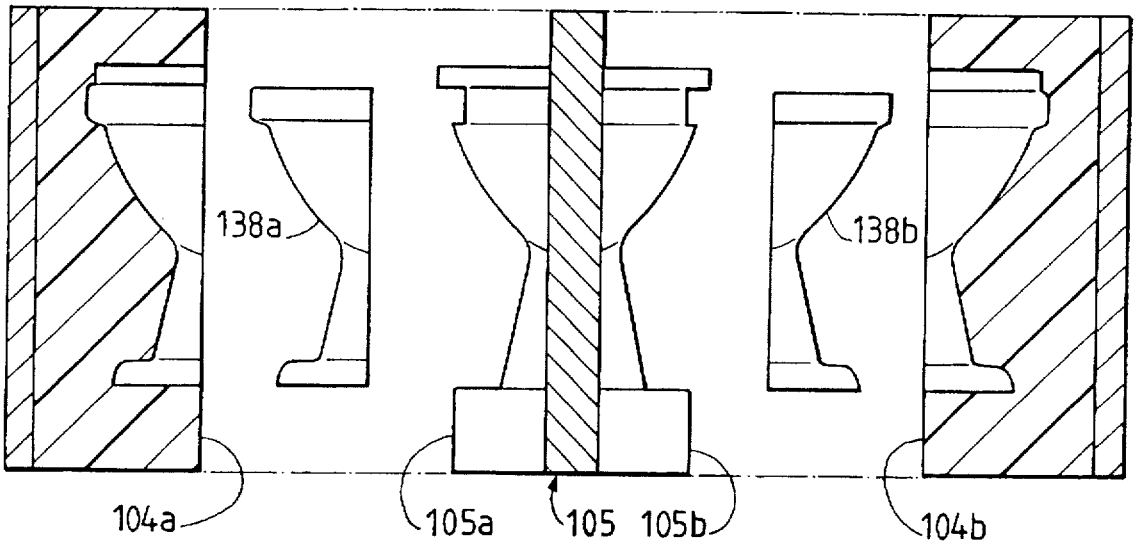
FIG. 6 shows a schematic view of the two molds shown in FIGS. 4 and 5, with two cast ceramic parts.
Figure 7:
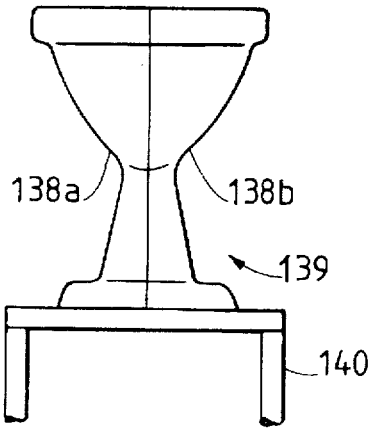
FIG. 7 shows a front view of the molding composed of the two ceramic parts of FIG. 6.

After the casting pressure required for pressure diecasting and simultaneously acting on both molds 106*a* and 106*b* has been built up, the water which is contained in the slip passes through the porous mold parts 104*a*, 104*b* and 105, whereupon a slip body 138*a* or 138*b* is formed inside each mold 106*a* and 106*b*, respectively. These two bodies 138*a* and 138*b*— also referred to below as ceramic parts—together in turn form the lavatory bowl which it is intended to produce, as shown in FIGS. 6 and 7.

The process sequence for casting the two ceramic parts 130*a* and 130*b* is virtually identical to the process described above for the production of a wash basin, so that a detailed description of the process which can be carried out with the apparatus 101 can be dispensed with.

The two parts 138*a* and 138*b* together form the molding 139 of the lavatory bowl which it is intended to produce. For the formation of the molding 139, the parts 138*a* and 138*b* are joined or bonded to one another at their vertical edges by means of a flowable slip, this preferably being effected in the moist state.

Removal of the ceramic parts 138*a* and 138*b* from the mold is preferably effected by means of a demolding device which is formed in order to remove the two parts 138*a* and 138*b* simultaneously and in the moist state from the opened molds 106*a* and 106*b* and to adhesively bond said parts with slip by means of a fixing robot and then—for drying—to place them on a stand 140. For this purpose, the demolding device and fixing robot are connected to the monitoring and control unit 132 to permit control.

A substantial advantage of the process which can be carried out with the apparatus 101 is that the two ceramic parts 138*a* and 138*b* which are to be connected to one another vertically are cast simultaneously in one process step and under the same physical conditions.

Figure 8:
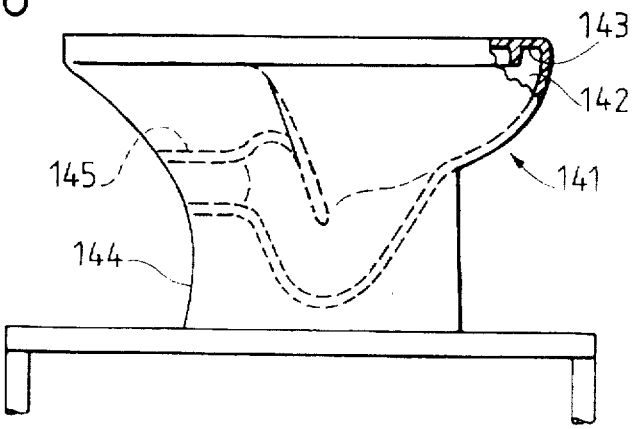
FIG. 8 shows a lateral view of a lavatory bowl which can be produced using an apparatus of the type shown in FIGS. 4 to 6.

FIG. 8 shows a lavatory bowl 141 which can be produced with an apparatus of the type shown in FIGS. 1 to 4. Here, this lavatory bowl has a water ring 143 which is opened in a downward direction and a drain trap pipe 145 emerging from the rear wall 144.

With the apparatus 101 described with reference to FIGS. 4 to 6, it is possible to produce lavatory bowls which have a S-shaped drain trap in a simple manner and without additional manual work. This is possible in particular because the apparatus 101 described above can be used to cast two ceramic parts, each of which forms a half-shell of the S-shaped drain trap.

A further embodiment of the invention is to be described with reference to FIGS. 9 to 12.

The apparatus shown in FIGS. 9 to 12 and denoted as a whole by 151 permits the production of a lavatory bowl having a closed water ring, as will be explained below. Like the apparatuses 1 and 101 described with references to FIGS. 1 to 6, the apparatus 151 has for this purpose a vertically displaceable bell 153, which is arranged on a holding device 152, and a plurality of mold parts. Six of the mold parts are shown and denoted by 154 to 159. Here, the mold parts 154, 155, 156 and 157, and the mold parts 158 and 159, each form a mold. The mold parts 157 and 158 are furthermore connected to one another in such a way that the two molds can be mounted vertically one on top of the other. The mold parts 154, 155 and 156 stand on a rigid plate 160, preferably formed from metal or concrete, and, together with the mold part 157 formed as a core, serve for the production of the bowl part of the lavatory bowl, as shown in FIG. 10. In contrast, the mold parts 158 and 159 serve for the production of the water ring.

The process for the production of the part-bodies 161 and 162 (FIG. 10) forming the bowl part and the water ring is substantially identical to the process described with reference to FIGS. 1 to 3 or 4 to 6, in this case the apparatus 151 of course being provided with a fixing robot which is formed for horizontal fixing.

Figure 12:
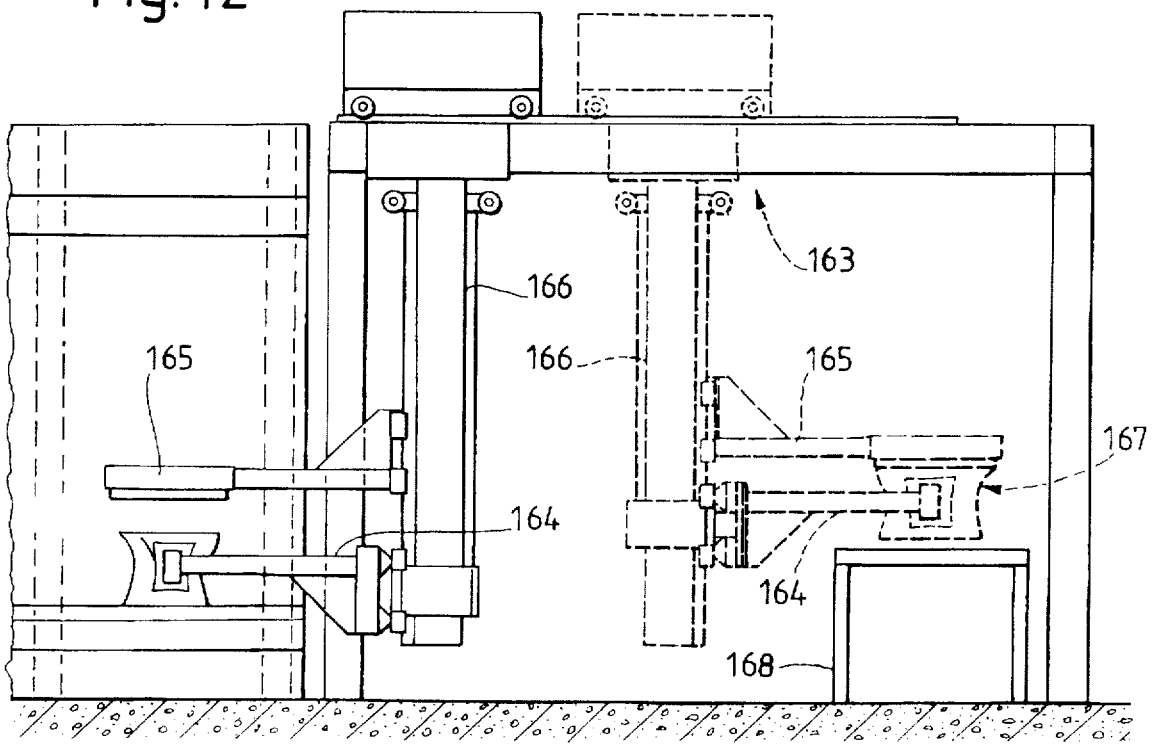
FIG. 12 shows a schematic view of a demolding device.

As already mentioned, a controllable demolding device is used for removing the moldings from the molds. Such a demolding device for the apparatus 151 is shown in FIG. 12 and is denoted by 163. This demolding device 163 has two horizontally and vertically displaceable holding arms 164 and 165 for holding and transporting the cast parts 161 and 162. The holding arm 164 has two supports 164*a* (only one being shown in the drawing), each of which is provided with a protector 64*b* intended to be placed on the body 161. The holding arms 164 and 165 are arranged on a horizontally displaceable carriage 166 in such a way that the two parts 161 and 162 can be united and fixed with the demolding device 163 in the vertical direction, and the molding 167 formed from the two parts 161 and 162 can be placed on a stand 168 for drying.

As already mentioned, fixing is effected by a robot which is not shown in the drawing and which is controllable by the monitoring and control unit 132. In order to permit optimal and exact fixing, by means of which the seam or joint lines are virtually invisible, the mold parts forming the molds may additionally be formed in such a way that, on casting, the part 161 is provided with an all-round groove in its end surface intended for resting on the part 162, and the part 162 is provided with a rib which fits into the groove.

Figure 9:
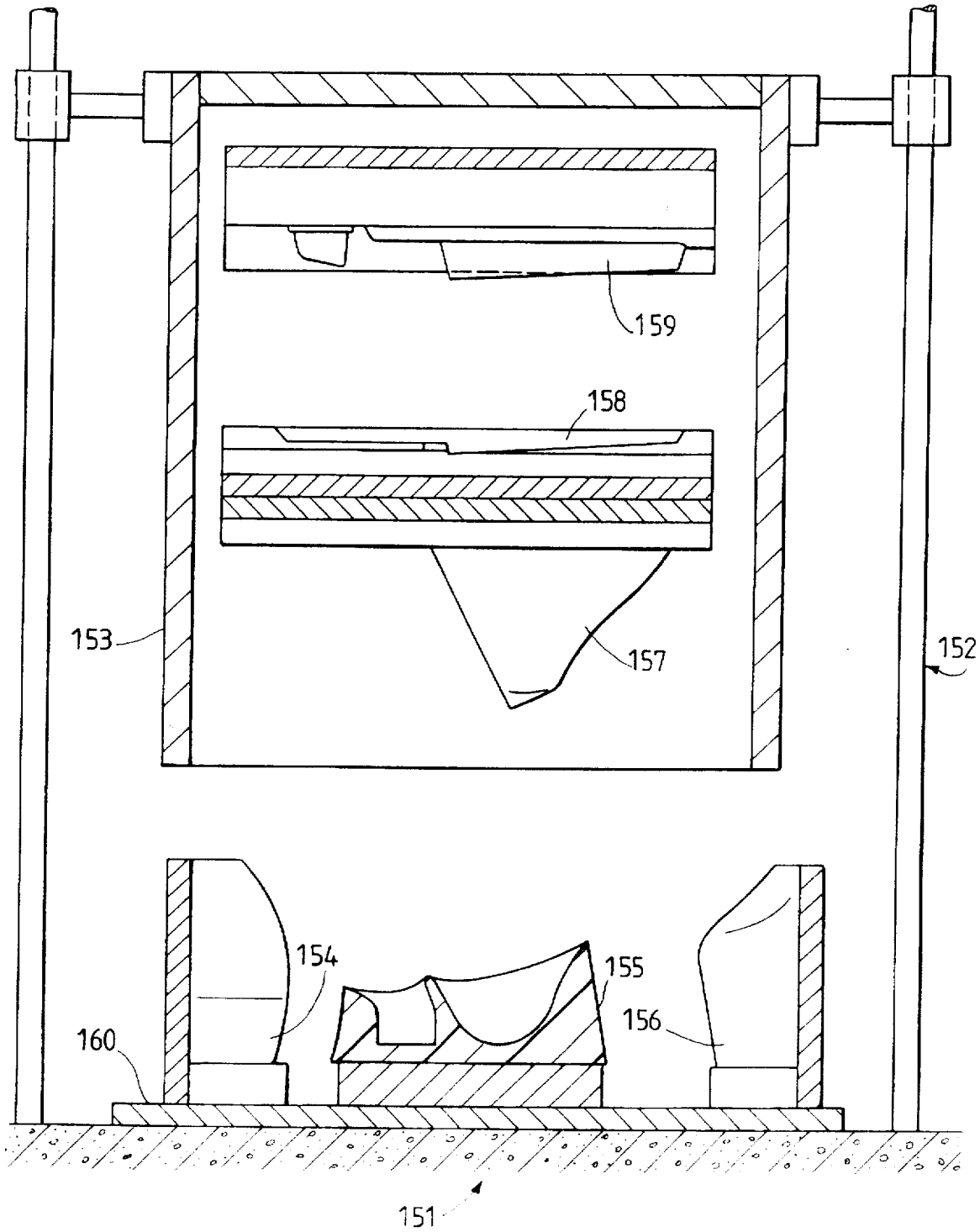
FIG. 9 shows a schematic view of an apparatus for the production of a ceramic lavatory bowl, with two molds arranged vertically one on top of the other.
Figure 10:
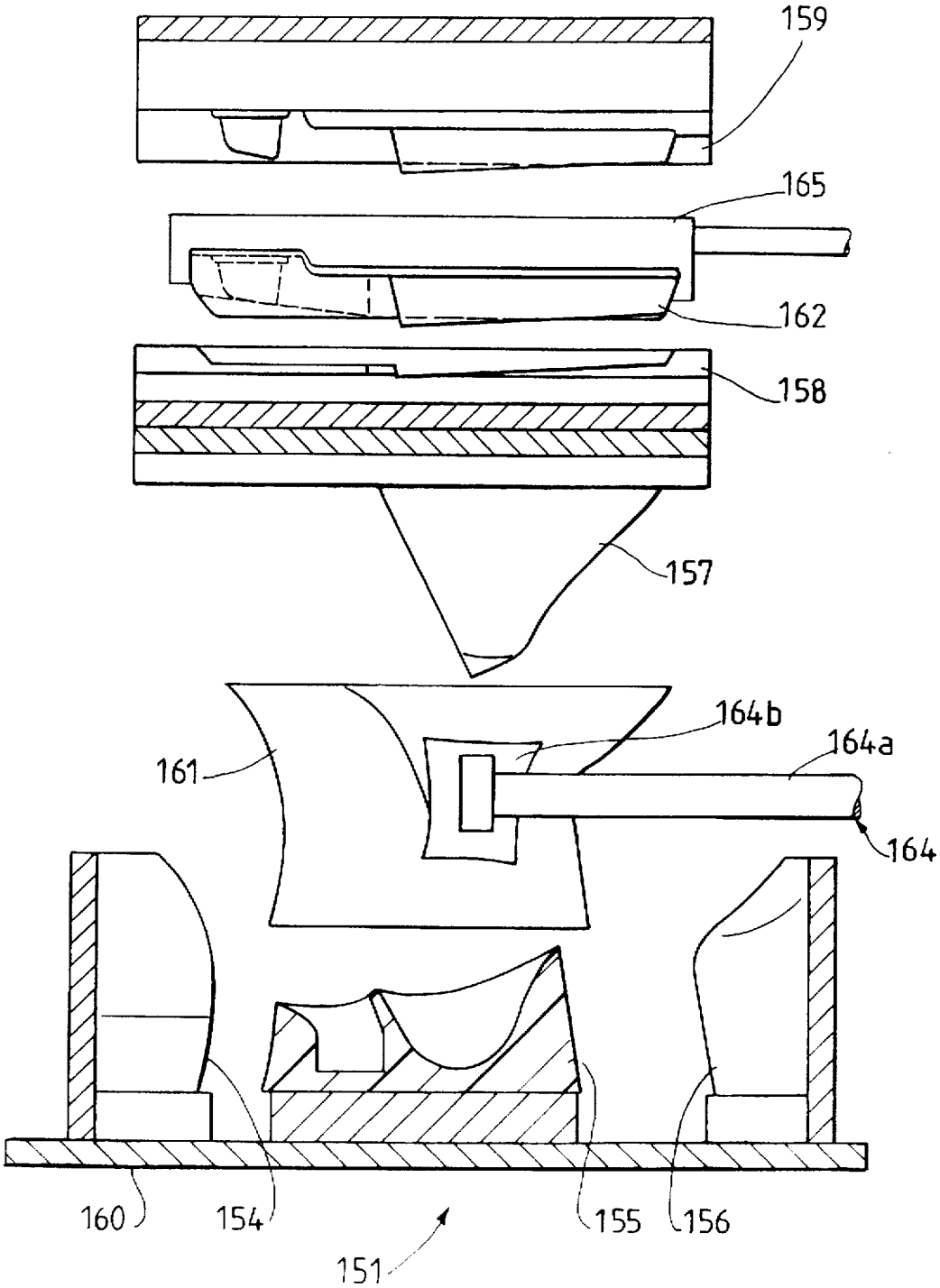
FIG. 10 shows a schematic view of the two molds shown in FIG. 9, with two cast ceramic parts.
Figure 11:
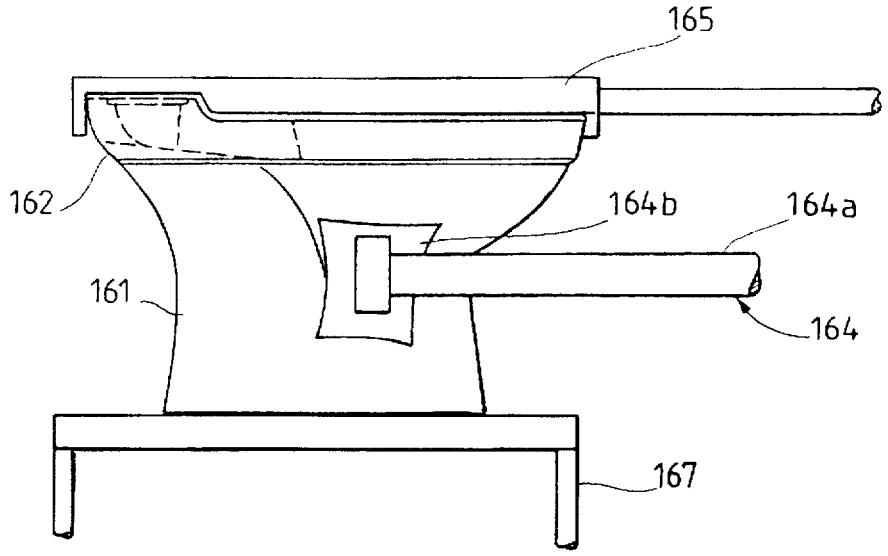
FIG. 11 shows a lateral view of the molding composed of the two ceramic parts of FIG. 10.
Figure 13:
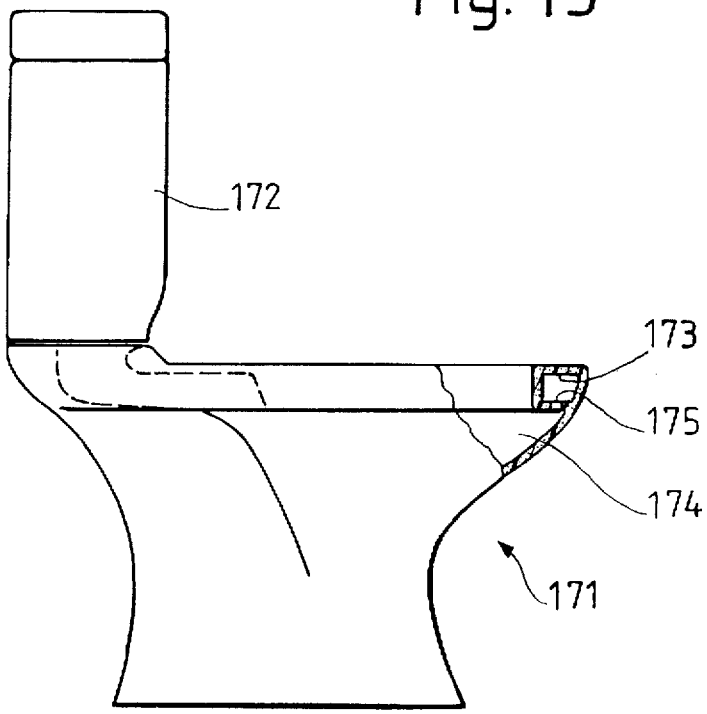
FIG. 13 shows a lateral view of a lavatory bowl which can be produced using an apparatus of the type shown in FIGS. 9 and 10.

FIG. 13 furthermore shows a lavatory bowl 171 which can be produced using an apparatus of the type shown in FIGS. 9 and 10. Here, said lavatory bowl has a cistern 172 and an essentially closed water ring 173 with orifices 175 leading into the interior space 174.

Figure 14:
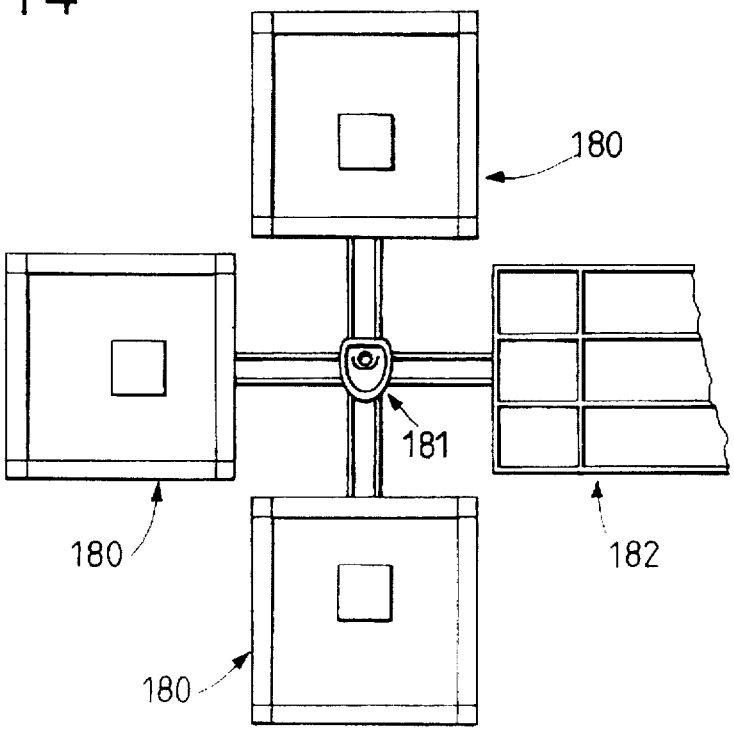
FIG. 14 shows a schematic view of a device having three casting apparatuses and a demolding device serving the three casting apparatuses.

Finally, FIG. 14 shows an arrangement of three apparatuses 180 of the type stated above, which are served by a common demolding device 181. The latter is preferably formed in such a way that it periodically takes up the bodies produced by each apparatus 180 and together forming a lavatory bowl, then joins said bodies vertically or horizontally to give a molding and finally places the latter on a drying unit 182, the bodies being adhesively bonded to one another along their joint line by means of a fixing robot prior to drying.

A monitoring and control unit of the type described above serves for controlling the apparatuses 180, said monitoring and control unit then additionally having control means for controlling the cyclic operation of the apparatuses 180 and switching means for automatically switching the demolding device 181.

Finally, it should also be mentioned at this point that the processes described with references to FIGS. 1 to 14 are only a selection from a plurality of possible embodiments of the invention and can be modified in various respects.

Thus, for example, another compressed gas or even pressurized water can also be used instead of compressed air for inflating the inflatable bladders 11 or 111.

The two parts 138*a* and 138*b* or 161 and 162 which can be connected to one another at vertical or horizontal planes are cast not only simultaneously but also with the same physical parameters. However, the apparatus according to the invention can of course also be formed, and provided with additional valve and control means, so that both the pressure and the amount of slip which can be introduced into the mold cavity per unit time can be regulated separately for each mold. According to the invention, however, such an apparatus can still be controlled so that the casting process can be completed simultaneously for both parts.

Finally, the process and apparatus can also be modified in such a way that the moldings to be produced can be composed of more than only two bodies or parts, for example of three or four bodies or parts, in these cases too, all molds used for producing the bodies or parts preferably being arranged inside only one chamber formed by a bell during operation of the apparatus.

What is claimed is:

1. A method of slip casting of ceramic parts, comprising the steps of:

providing a chamber without a fluid-tight seal and formed by a vertically displaceable bell;

arranging at least a first mold having a cavity and formed of porous mold parts in the chamber, so that the first mold is surrounded, at least partially, by an intermediate space in which a plurality of inflatable bladders is provided;

filling the plurality of inflatable bladders provided in the intermediate space with fluid and subjecting the fluid in the inflatable bladders to a pressure, which is at least equal to a first pressure by which slip is introduced into the mold cavity, in order to restrain the first mold in the chamber;

thereafter, filling the cavity of the first mold by introducing slip under the first pressure which is greater than an ambient air pressure;

subjecting, during a casting process, the slip, which fills the cavity of the first mold to a second pressure, with a result that water from the slip enters the mold parts, of which the first mold is formed, until a ceramic part of a predetermined thickness is formed inside the cavity;

simultaneously, subjecting the fluid, which fills the inflatable bladders, to a pressure at least equal to the second pressure to hold the first mold together in a pressure-resistant manner during the casting process;

after formation of the ceramic part, removing residual slip from the mold cavity and removing the ceramic part from the first mold.

2. A method as claimed in claim 1, wherein the pressure, which is applied to the inflatable bladders to hold the first mold together during the casting process, is equal to the second pressure, and wherein the method further comprises the step of providing pressure-communicating means for applying the second pressure to the slip and the fluid in the inflatable bladders.

3. A method as claimed in claim 1, further comprising the steps of arranging in the chamber a second mold side by side with the first mold for producing a ceramic lavatory formed of two ceramic parts connectable at vertical edges thereof, the intermediate space surrounding at least partially, both molds;

simultaneously casting the two parts in both molds; and after formation of the two parts, removing the slip from both molds and removing the two parts from the molds for subsequent connection of the two parts vertically to one another by adhesive bonding with the slip to form a lavatory.

4. A method as claimed in claim 1, further comprising the steps of:

arranging in the chamber a second mold on top of the first mold for producing a ceramic lavatory formed of two ceramic parts connectable at horizontal edges thereof, the intermediate space surrounding, at least partially, both molds;

simultaneously casting the two parts in both molds; and after formation of the two parts, removing the slip from both molds and removing the two parts from the molds for subsequent connection of the two parts horizontally to one another by adhesive bonding with the slip to form a lavatory.

5. A method as claimed in claim 1, comprising the step of providing a control unit for controlling the slip casting of the ceramic parts.

6. A method as claimed in claim 1, wherein said step of filling the plurality of inflatable bladders with fluid comprises filling the plurality of inflatable bladders with air, and said step of subjecting the fluid to pressure equal at least the second pressure includes subjecting the fluid to a pressure of 1 to 2 Mpa.

7. A method as claimed in claim 1, further comprising the step of passing into the mold cavity, after formation of the ceramic part, a fluid in order to remove the residual slip from the mold cavity and to further dewater the ceramic part.

8. A method as claimed in claim 7, wherein said fluid passing step comprises passing the fluid into the mold cavity under a pressure greater than the ambient pressure.

9. A method as claimed in claim 1, wherein each of said steps of subjecting the fluid to a pressure at least equal to the first pressure and to a pressure at least equal to the second pressure, respectively, include regulation of a pressure built-up in each of the inflatable bladders separately.

10. An apparatus for slip casting of ceramic parts, comprising:

a chamber without a fluid tight seal and formed by a vertically displaceable bell;

at least one mold having a cavity and formed of a plurality of porous mold parts and arranged in said chamber so that an intermediate space surrounds said at least one mold;

a plurality of inflatable bladders located in said intermediate space; and means for filling said inflatable bladders with fluid for enabling said inflatable bladders to restrain said at least one mold during a slip casting process.

11. An apparatus as claimed in claim 10, further comprising means for communicating said inflatable bladders with the mold cavity.

12. An apparatus as claimed in claim 10, further comprising a slip reservoir, and means for communicating said slip reservoir with the mold cavity and the inflatable bladders.

13. An apparatus as claimed in claim 10, further comprising another mold arranged in said chamber for simultaneous slip casting of two ceramic parts.

14. An apparatus as claimed in claim 10, further comprising a control unit for controlling the slip casting of ceramic parts.

* * * * *